US005251893A

United States Patent [19]

Schoenhenz

[11] Patent Number: 5,251,893

[45] Date of Patent: Oct. 12, 1993

[54] MECHANISM FOR INSERTING A FLAT OBJECT INTO A PROCESSING DEVICE FOR PROCESSING SAID OBJECT

[75] Inventor: Daniel Schoenhenz, Ballancourt, France

[73] Assignee: Societe Anonyme Dite, Bretigny-sur-Orge, France

[21] Appl. No.: 995,592

[22] Filed: Dec. 22, 1992

[30] Foreign Application Priority Data

Dec. 24, 1991 [FR] France ..... 91 16097

[51] Int. Cl.[5] ..... B65H 9/16

[52] U.S. Cl. ..... 271/251; 271/248; 271/252; 271/274; 271/902

[58] Field of Search ..... 271/248, 250, 251, 252, 271/274, 902

[56] References Cited

U.S. PATENT DOCUMENTS 3,915,449 10/1975 Johnson et al. ..... 271/274
4,505,471 3/1985 Stockburger et al. ..... 271/251
4,836,527 6/1989 Wong .
4,919,318 4/1990 Wong ..... 271/250

FOREIGN PATENT DOCUMENTS 0193258 9/1986 European Pat. Off. .
3034517 10/1981 Fed. Rep. of Germany .
264440 11/1991 Japan ..... 271/274

*Primary Examiner*—H. Grant Skaggs
*Attorney, Agent, or Firm*—Sughrue, Mion, Zinn, Macpeak & Seas

[57] ABSTRACT

A mechanism for inserting a flat object into a processing device for processing the object, the processing device including a fixed frame having an insertion slot via which the object is inserted, the slot forming a passage having a wall which is perpendicular to the surface of said flat object, and which serves as a reference abutment surface for one side of said flat object, the mechanism being wherein the mechanism includes two wheels, each of which penetrates into the slot via a respective aperture, at least one of the wheels being mounted at the end of a rocker arm whose other end is mounted in a cradle to pivot about a rocking axis that is parallel to the direction F in which the flat object is inserted, wherein the cradle is in turn mounted in the fixed frame to pivot about a swivel axis that is perpendicular to the plane of the insertion slot, wherein resilient elements apply a certain pressure to press the wheels together, and wherein an abutment delimits the swivelling stroke of the cradle about the swivel axis.

5 Claims, 3 Drawing Sheets

MECHANISM FOR INSERTING A FLAT OBJECT INTO A PROCESSING DEVICE FOR PROCESSING SAID OBJECT

The present invention relates to a mechanism for inserting a flat object into a processing device for processing said object.

The invention applies in particular to card readers, but also to any apparatus receiving a flat object where one side of the object has to be run along a reference face so as to position the object properly relative either to a reading and/or writing head, or to any device for processing said object.

BACKGROUND OF THE INVENTION

When such an object is inserted manually into an insertion slot, and is then driven either manually or by motorized means, the object does not always slide along the reference face of the apparatus, and, as a result, the processing of the object by a reading and/or writing head or by an arbitrary processing device cannot be performed correctly because the processing member in the apparatus, and the complementary member on the object that co-operates with the processing member are not properly aligned.

An object of the invention is to provide a mechanism enabling such a flat object to be conveyed against a reference face of a device for receiving such an object for the purposes of processing it.

SUMMARY OF THE INVENTION

The invention therefore provides a mechanism for inserting a flat object into a processing device for processing said object, the processing device including a fixed frame having an insertion slot via which said object is inserted, said slot forming a passage having a wall which is perpendicular to the surface of said flat object, and which serves as a reference abutment surface for one side of said flat object, wherein the mechanism includes two wheels, each of which penetrates into said slot via a respective aperture, at least one of the wheels being mounted at the end of a rocker arm whose other end is mounted in a cradle to pivot about a rocking axis that is parallel to the direction in which said flat object is inserted, wherein said cradle is in turn mounted in said fixed frame to pivot about a swivel axis that is perpendicular to the plane of said insertion slot, wherein resilient means apply a certain pressure to press the wheels together, and wherein an abutment delimits the stroke of said cradle about said swivel axis.

In a particular embodiment, one of said two wheels is mounted on a fixed axis and is rotated by means of a drive motor, the wheel situated at the end of a rocker arm being mounted on the arm with friction means being interposed to cause a certain amount of resistance to the wheel rotating freely.

According to another feature, when said cradle is in its central rest position, a locking pin carried by said fixed frame, or by said rocker arm co-operates with a recess provided in said rocker arm, or in said fixed frame, to prevent said cradle from swivelling about said swivel axis, said passage including a slope downstream of the fixed-axis motorized wheel whose position corresponds to that of the wheel mounted at the end of the rocker arm, when said cradle is in its rest position, which slope forces said flat object to be displaced, during its stroke, towards said wheel mounted at the end of said rocker arm, and causes said pin to come out of said recess, return means being provided for bringing the cradle back to its central rest position after said flat object has passed through.

In another embodiment in which the flat object is driven manually, one of said two wheels is mounted to freewheel about a fixed axis, said cradle including a return spring to return it to its central rest position, the wheel situated at the end of a rocker arm being mounted on the arm with friction means being interposed to cause a certain amount of resistance to the wheel rotating freely, the rocker arm wheel having a high coefficient of friction and the fixed-axis wheel having a low coefficient of friction, and, when said cradle is in said rest position, a locking pin carried by said fixed frame, or by said rocker arm, co-operating with a recess provided in said rocker arm, or in said fixed frame, to prevent said cradle from swivelling about said swivel axis, said passage including a slope downstream of the fixed-axis wheel whose position corresponds to that of the wheel mounted at the end of the rocker arm, when said cradle is in its rest position, which slope forces said flat object to be displaced, during its stroke, towards said wheel mounted at the end of said rocker arm, and causes said pin to come out of said recess.

In a preferred embodiment, in which the flat object is driven manually, each of the two wheels is mounted at the end of a respective rocker arm, each of the two rocker arms being mounted in said cradle to pivot about a respective rocking axis, said cradle including a return spring to bring it back to its central rest position, at least one of the two wheels being mounted at the end of its rocker arm with friction means being interposed to cause a certain amount of resistance to the wheel moving freely, at least that wheel having a high coefficient of friction, and, when said cradle is in said rest position, a locking pin carried by said fixed frame, or by one of said two rocker arms, co-operating with a recess provided in one of said two rocker arms, or in said fixed frame, to prevent said cradle from swivelling about said swivel axis, said passage including a slope downstream of said wheels, in their positions corresponding to the cradle being in said rest position, which slope forces said object to be displaced, during its stroke, towards that one of the two rocker arms which carries said recess, or said pin, and causes said pin to come out of said recess.

BRIEF DESCRIPTION OF THE DRAWINGS

Four embodiments of the invention are described below by wa of example and with reference to the accompanying drawings, in which.

DETAILED DESCRIPTION

Figure 1:
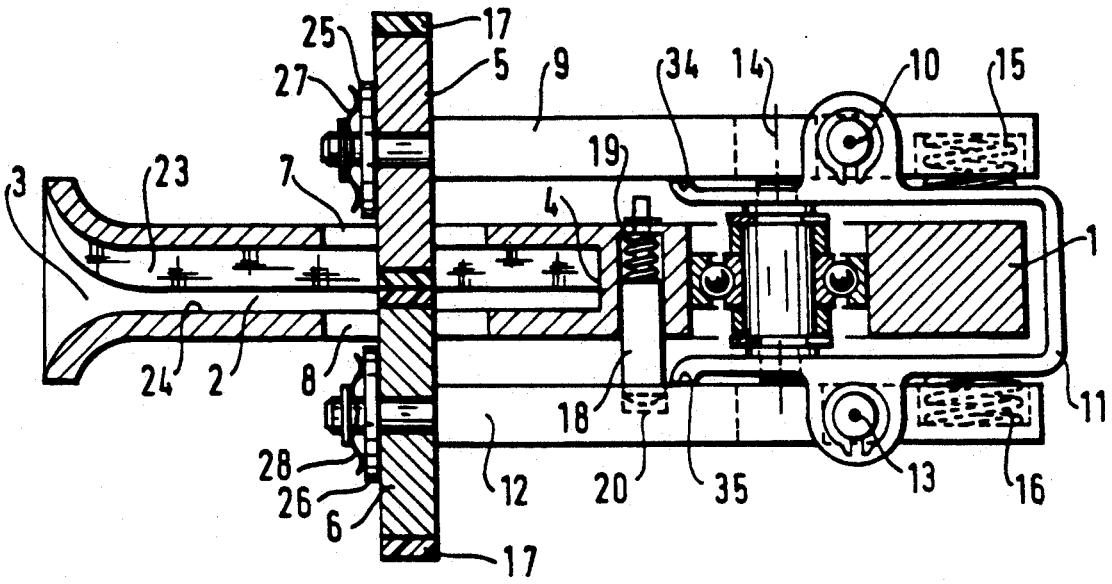
FIG. 1 is a diagram showing a preferred mechanism of the invention in which a card is both inserted and driven manually.

A manual drive mechanism is described below with reference to FIGS. 1 and 2. This application is particularly advantageous because it avoids any motorization.

A flat object such as a card is to be driven into a processing device (not shown) carried by a fixed frame 1. For the processing to be performed correctly, the card must follow a perfectly defined path while it is being conveyed. To do this, a reference abutment face is required for one side of the card (its edge). In general, the reference face is constituted by one wall of the passage extending the slot via which the card is inserted into the apparatus. The wall is perpendicular to the plane of the card.

In this embodiment, the frame 1 has an insertion slot 2 that is open along one side at 3 because the card is driven manually, and the reference face is the wall 4 perpendicular to the plane in which the card is inserted. The wall 4 of the conveying passage is represented in FIG. 2 by the line 4. When the card is being inserted and driven along, the user might not press the edge of the card against the reference face 4, and the card might then not be processed correctly, e.g. the magnetic strip might not be read properly.

The object of the mechanism of the invention that is described below is to enable the edge of the card to be pressed against the reference abutment face 4 even if the user inserts the card without paying proper attention to this requirement.

The mechanism includes a first wheel 5 and a second wheel 6. Wheel 5 penetrates into the insertion slot 2 via an aperture 7 and wheel 6 penetrates into the insertion slot via an aperture 8.

Wheel 5 is mounted at the end of a first rocker arm 9 whose other end pivots about a rocking axis 10 in a cradle 11. In the same way, wheel 6 is mounted at the end of a second rocker arm 12 whose other end pivots about a rocking axis 13 in the cradle 11. The rocker axes 10 and 13 are parallel to the direction in which the card is inserted into the slot 2. The cradle in turn pivots about a swivel axis 14 in the fixed frame 1. The swivel axis 14 of the cradle 11 is perpendicular to the insertion slot 2.

The two wheels 5 and 6 press against each other with a certain pressure by means of springs 15 and 16 acting on the rocker arms 9, 12 and bearing against the cradle 11.

Each of the wheels 5, 6 is covered with a layer 17 of a material having a high coefficient of friction, e.g. rubber.

The frame 1 further carries a locking pin 18 pushed by a spring 19, which locking pin enables the swivelling cradle 11 to be locked in its central rest position, i.e. in the position in which the rocker arms 10, 13 are properly parallel to the direction in which a card is inserted into the insertion slot 2. To perform said locking, the pin 18 penetrates into a recess 20 provided in rocker arm 12.

Naturally, the pin 18 could be carried by arm 12 and the recess could be provided in the fixed frame 7. Similarly, the cradle 11 could be locked between arm 9 and the frame 1 instead of between arm 12 and the frame. The clockwise swivelling stroke of the cradle 11, as shown in FIG. 2, is delimited by an abutment 21. A return spring 22 exerts anticlockwise torque on the cradle, as shown in FIG. 2. When the cradle swivels anticlockwise, an abutment 40 stops the cradle in the rest position in which the locking pin 18 can penetrate into its recess 20.

Beyond the wheels, in their rest positions, in the direction in which a card is inserted, the insertion passage 2 includes a slope 23 reducing the height of the passage and causing the card to be displaced towards the opposite face 24 of the passage. This causes arm 12 to pivot about its rocking axis 13, and as a result the cradle 11 is unlocked by the pin 18 being released from its recess 20.

Each wheel 5, 6 is mounted on its respective rocker arm 9, 12 via a respective friction washer 25, 26, and via a respective resilient abutment washer 27, 28. This causes a certain amount of resistance to the wheels rotating.

The mechanism operates as follows:

A user inserts a card into the insertion slot 2 in the direction of arrow F.

As a result of the relatively small force exerted by the user, the two wheels rotate and move apart by means of the springs 15 and 16 compressing. As the wheels move apart, the pin 18 starts to be released from the recess 20 but is not completely released.

When the front edge of the inserted card reaches the slope 23, the slope forces the card to become offset towards wheel 6, and thereby to cause rocker arm 12 to be pivoted further against spring 16. This further pivoting of arm 12 finishes releasing the pin 18 from its recess, and the cradle 11 is then unlocked, and is therefore free to pivot about its swivel axis 14.

Since the rotation of the wheels 5 and 6 is slightly braked by the friction washers 25, 26, the resistance to the rotation generates a tangential friction force F' in the opposite direction from arrow F, opposing advance of the card.

The user continuing to drive the card in the direction of arrow F therefore immediately causes the cradle 11, and therefore the arms 9, 12, to swivel, until the cradle is stopped by the abutment 21. While the cradle is swivelling, the wheels 5, 6 no longer rotate. In FIG. 2 the position of the arms and of the wheels when the cradle is in the abutment position after it has been swivelled is shown by dot-dashed lines.

Figure 2:
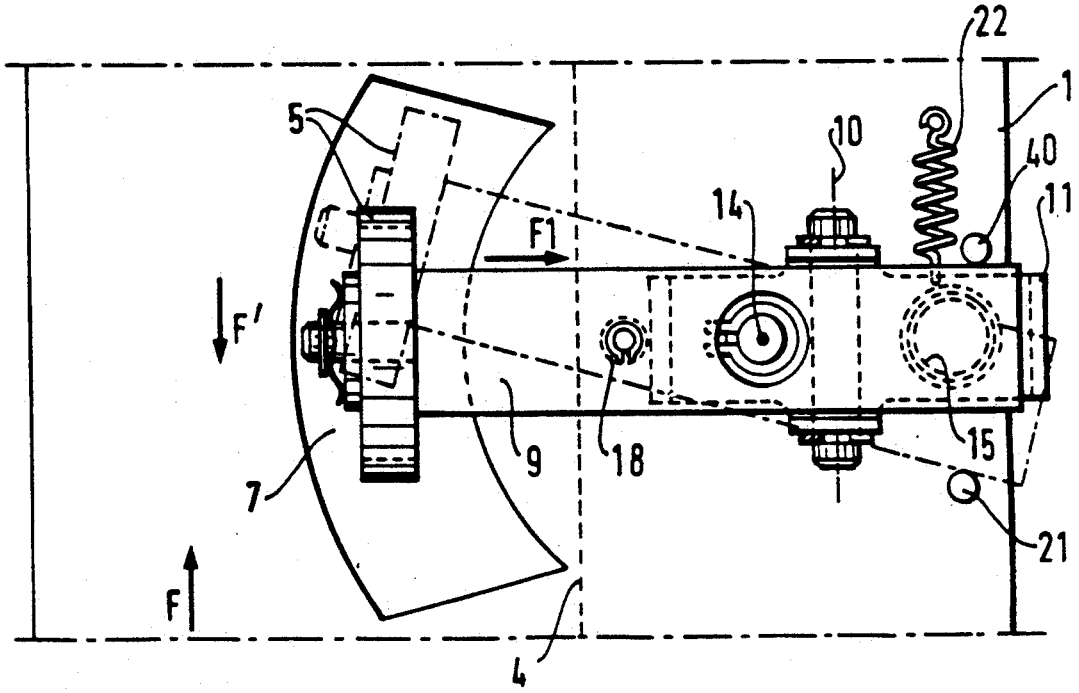
FIG. 2 is a plan view of the FIG. 1 mechanism.

As can be easily understood from FIG. 2, the cradle swivelling causes the card to be brought closer to the reference abutment face 4.

The user continuing to drive the card causes the wheels 5, 6 to be rotated again (since the friction force of the card against the wheels, due to the high coefficient of friction of the wheels against the card, is naturally greater than the resistance to the wheels rotating due to the friction washers 25, 26).

During rotation of the wheels, and given the coefficient of friction and the inclined angular position of the wheels relative to the abutment face 4, the card is subjected to a force $F_1$ (FIG. 2) urging it closer to, or maintaining it against the reference abutment face 4.

After the rear edge of the card has been released from the wheels, the return spring 22 urges the cradle 11 back into its neutral rest position, in which the pin 18 pushed by spring 19 engages in its recess 20, thereby locking the moving assembly again, so that it is ready operate once more.

Figure 6:
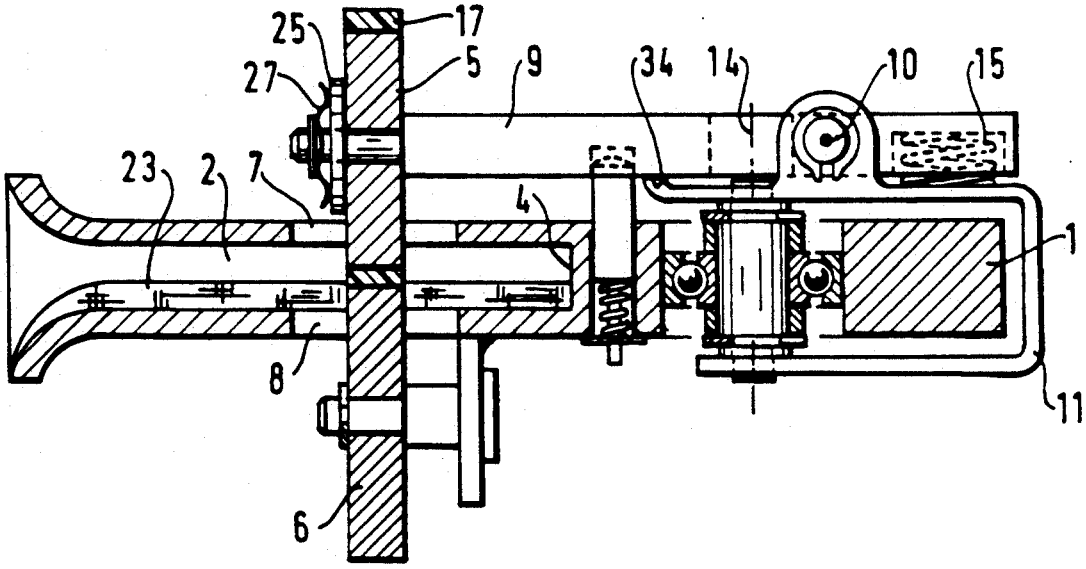
FIG. 6 shows another manual embodiment which has only one rocker arm.

In this embodiment, each of the two wheels is mounted at the end of a respective rocker arm. It is also possible to have only one wheel 5 mounted on a rocker arm and the other wheel 6 mounted on a fixed axis. However that solution is less advantageous because the fixed-axis wheel 6 must be covered with a layer having a coefficient of friction that is as low as possible. FIG. 6 shows such an example.

Figure 3:
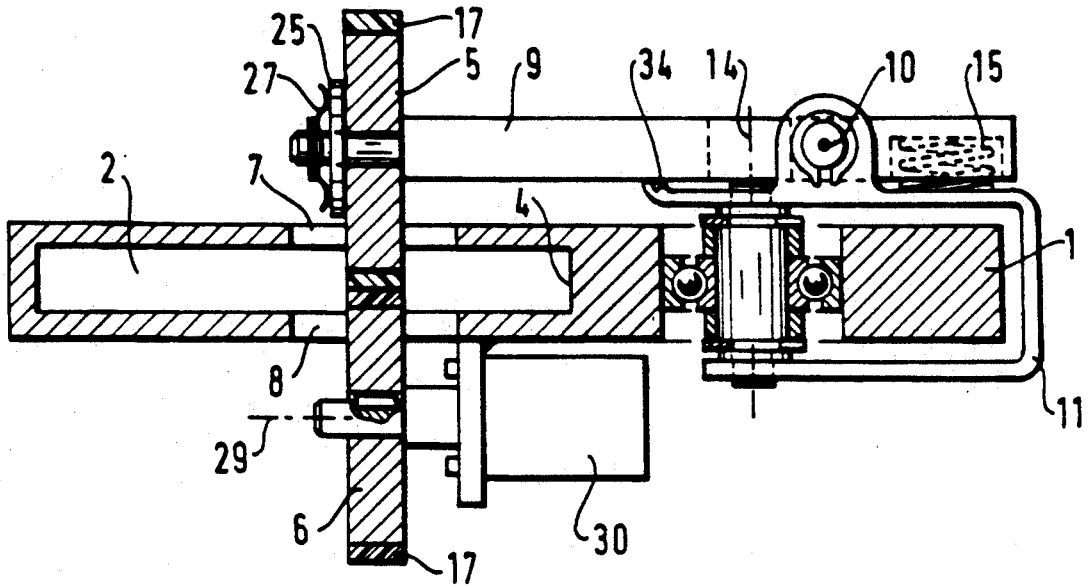
FIGS. 3 and 4 show a second embodiment of the mechanism of the invention in which the flat object to be processed is inserted manually but is driven by motorized means (in this embodiment, the mechanism enables the object to be processed to effect both a go stroke and a return stroke)
Figure 4:
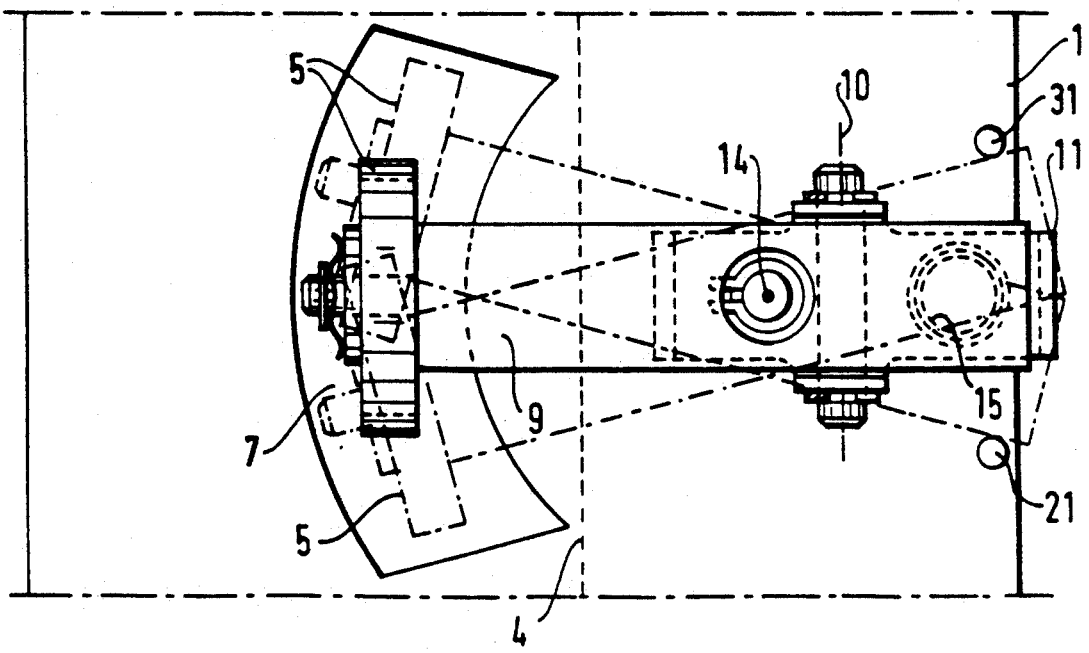

FIGS. 3 and 4 show a motorized embodiment enabling the card to be moved in both directions (with the card effecting a go stroke and a return stroke to be returned via the insertion slot). In this embodiment, wheel 6 has a fixed axis 29 and has a drive motor 30. Wheel 5 is, as in the preceding embodiment, mounted at the end of a rocker arm 9 pivotally-mounted in a swivelling cradle 11.

However, in this case, there is no locking device comprising a pin and a recess. This is to allow the cradle 11 to swivel beyond the neutral rest position during the return stroke of the card. There is also no slope 23 in the insertion passage 2. An abutment 31 delimits the swivelling stroke of the cradle in the direction corresponding to the return stroke of the card.

This embodiment does not make use of the effect of bringing the card towards the reference surface 4 due to the cradle swivelling, because, in this case, since the cradle is not locked in its rest position, it pivots as soon as the drive wheel 6 starts rotating until it is stopped by coming up against the abutment 21, before being lifted so as to allow the card to pass between the two wheels. Naturally, as in the preceding case, use is made of the force in the direction of arrow $F_1$ due to the inclination of wheel 5.

In this embodiment, there is no need to provide a friction washer on the fixed-axis wheel 6. However, to enable the cradle 11 to be swivelled against the abutment 31 during the return stroke of the card, it is necessary to cause a certain amount of resistance to wheel 5 rotating freely so as to obtain a tangential friction force between the card and the wheel 5, causing the cradle 11 to swivel. Wheel 5 is therefore mounted, as in the preceding case, with a friction washer 25, and a resilient washer 27.

In this embodiment, both wheels 5 and 6 are covered with respective layers of rubber or of any other material having a good coefficient of friction. The drive wheel 6 is rotated in either direction by the flat object going past a cell. The drive wheel rotating in either direction immediately cause the cradle to pivot, and it is not necessary to bring the cradle back to its central rest position at the end of the cycle.

In the embodiment shown in FIGS. 1 and 2, the rocking strokes of the rocker arms 9 and 12 in the directions in which they urged by the springs 15 and 16 are delimited by abutments 34 and 35 on the cradle 11.

In the embodiment shown in FIGS. 3 and 4, the rocking stroke of the rocker arm is also delimited by an abutment 34.

In both cases, the abutments do not prevent the two wheels from coming into contact with each other in the absence of a card.

Figure 5:
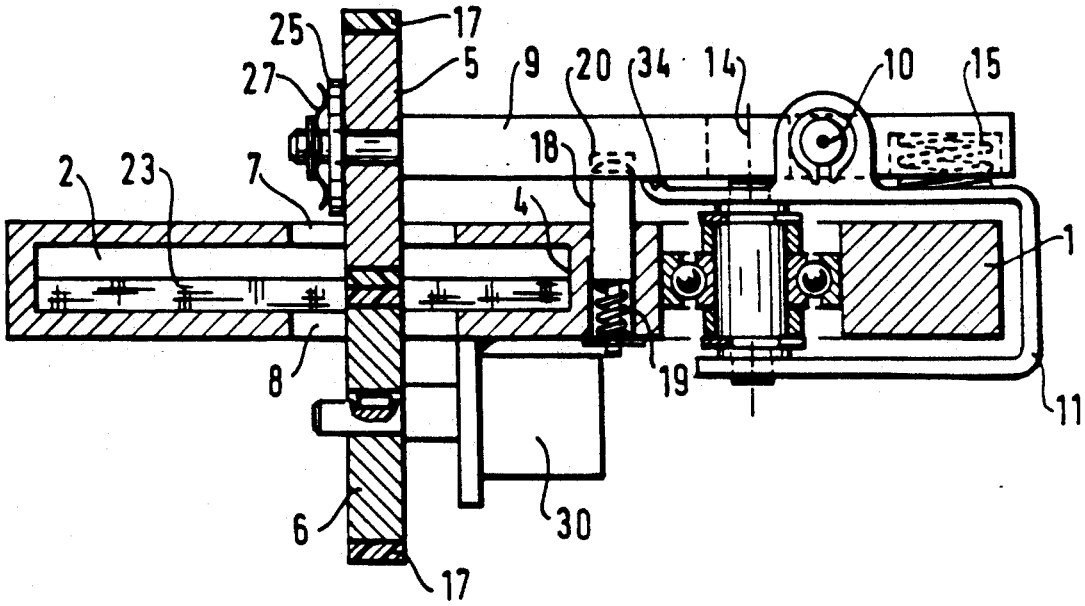
FIG. 5 shows another motorized embodiment, in which the card effects a go stroke only, and is then returned via the rear end of the apparatus.

If the apparatus is motorized and is designed to drive the card over a go stroke only (instead of over both a go stroke and a return stroke) with the card being retrieved via the other end of the apparatus, a locking system may then be provided with a pin 18 and a recess 20 for locking the cradle 11, as in the manual mechanism shown in FIGS. 1 and 2, so as to take advantage of the card being brought closer to the face 4 by the cradle 11 swivelling. To unlock the cradle, once the card is engaged between the two wheels 5 and 6, the slope 23 is also necessary, as in the FIG. 1 embodiment. This motorized embodiment providing go motion only is shown in FIG. 5. In this case, after the card has passed through, the cradle must be returned to its central rest position. This can be done by running the motor 30 in the opposite direction, with the motor being triggered by the card going past a photo-electric cell.

I claim:

1. A mechanism for inserting a flat object into a processing device for processing said object, the processing device including a fixed frame having an insertion slot via which said object is inserted, said slot forming a passage having a wall which is perpendicular to a plane in which the flat object is inserted, and which serves as a reference abutment surface for one side of said flat object, wherein the mechanism includes two wheels, each of which penetrates into said slot via a respective aperture, at least one of the wheels being mounted at the end of a rocker arm whose other end is mounted in a cradle to pivot about a rocking axis that is parallel to the direction (F); in which said flat object is inserted, wherein said cradle is in turn mounted in said fixed frame to pivot about a swivel axis that is perpendicular to the plane of said insertion slot, wherein resilient means apply a certain pressure to press the wheels together, and wherein an abutment delimits the swivelling stroke of said cradle about said swivel axis.

2. A mechanism according to claim 1, wherein one of said two wheels is mounted on a fixed axis and is rotated by means of a drive motor, the wheel situated at the end of a rocker arm being mounted on the arm with friction means being positioned against the wheel to cause a certain amount of resistance to the wheel rotating freely.

3. A mechanism according to claim 2, wherein, when said cradle is in its central rest position, a locking pin carried by said fixed frame, or by said rocker arm co-operates with a recess provided in said rocker arm, or in said fixed frame, to prevent said cradle from swivelling about said second axis, said passage including a slope downstream of the fixed-axis motorized wheel whose position corresponds to that of the wheel mounted at the end of the rocker arm, when said cradle is in its rest position, which slope forces said flat object to be displaced, during its stroke, towards said wheel mounted at the end of said rocker arm, and causes said pin to come out of said recess, and wherein return means are provided for bringing the cradle back to its central rest positon after said flat object has passed through.

4. A mechanism according to claim 1, wherein one of said two wheels is mounted to freewheel about a fixed axis, said cradle including a return spring to return it to its central rest position, wherein the wheel situated at the end of a rocker arm is mounted on the arm with friction means being positioned against the wheel to cause a certain amount of resistance to the wheel rotating freely, the rocker arm wheel having a high coefficient of friction and the fixed-axis wheel having a low coefficient of friction, and wherein, when said cradle is in said rest position, a locking pin carried by said fixed frame, or by said rocker arm, co-operates with a recess provided in said rocker arm, or in said fixed frame, to prevent said cradle from swivelling about said swivel axis, said passage including a slope downstream of the fixed-axis wheel whose position corresponds to that of the wheel mounted at the end of the rocker arm, when said cradle is in its rest position, which slope forces said flat object to be displaced, during a return motion, towards said wheel mounted at the end of said rocker arm, and causes said pin to come out of said recess.

5. A mechanism according to claim 1, wherein each of the two wheels is mounted at the end of a respective rocker arm, each of the two rocker arms being mounted in said cradle to pivot about a respective rocking axis, said cradle including a return spring to bring it back to its central rest position, wherein at least one of the two wheels is mounted at the end of its rocker arm with friction means being positioned against the wheel to cause a certain amount of resistance to the wheel moving freely, at least that wheel having a high coefficient of friction, and in that, when said cradle is in said rest position, a locking pin carried by said fixed frame, or by one of said two rocker arms, co-operates with a recess provided in one of said two rocker arms, or in said fixed frame, to prevent said cradle from swivelling about said swivel axis, said passage including a slope downstream of said wheels, in their positions corresponding to the cradle being in said rest position, which slope forces said flat object to be displaced, during a return motion, towards that one of the two rocker arms which carries said recess, or said pin, and causes said pin to come out of said recess.

* * * * *

UNITED STATES PATENT AND TRADEMARK OFFICE

CERTIFICATE OF CORRECTION

PATENT NO. : 5,251,893

DATED : October 12, 1993

INVENTOR(S) : Schoenhenz

It is certified that error appears in the above-indentified patent and that said Letters Patent is hereby corrected as shown below:

Title page, Section [73] Assignee: delete "Societe Anonyme Dite, Bretigny-sur-Orge, France" and insert --Compagnie Generale D'Automatisme CGA-HBS
Le Plessis Pate
Bretigny-Sur-Orge, France --

Signed and Sealed this

Fifteenth Day of November, 1994

Bruce Lehman

*Attest:*

BRUCE LEHMAN

*Attesting Officer*

*Commissioner of Patents and Trademarks*